United States Patent [19]

Frink et al.

[11] Patent Number: 4,875,530

[45] Date of Patent: Oct. 24, 1989

[54] AUTOMATIC DRILLING SYSTEM

[75] Inventors: Tommy S. Frink, Tulsa; Lowell M. Reed, Oklahoma City, both of Okla.; Dwayne V. Cochran, Midland; Will L. McNair, Sugerland, both of Tex.

[73] Assignee: Parker Technology, Inc., Odessa, Tex.

[21] Appl. No.: 328,774

[22] Filed: Mar. 24, 1989

Related U.S. Application Data

[63] Continuation of Ser. No. 100,567, Sep. 24, 1987, abandoned.

[51] Int. Cl.[4] ..... E21B 44/00; B66D 5/20; B66D 5/26

[52] U.S. Cl. ..... 175/27; 254/269; 254/270; 254/377

[58] Field of Search ..... 175/24, 27; 73/151; 254/267–275, 340, 361, 377, 375

[56] References Cited

U.S. PATENT DOCUMENTS

| | | | |
|---|---|---|---|
| 1,924,317 | 8/1933 | Hau et al. | 254/270 X |
| 1,985,889 | 1/1935 | DeLa Mater et al. | 254/377 |
| 2,219,215 | 10/1940 | Anderson | 254/377 |
| 2,416,638 | 2/1947 | Morton | 254/377 |
| 3,461,978 | 8/1969 | Whittle | 175/27 |
| 3,653,636 | 4/1972 | Burrell | 254/270 |
| 3,716,106 | 2/1973 | Peterson | 175/27 X |
| 3,891,038 | 6/1975 | Delestrade et al. | 175/27 X |
| 3,917,230 | 11/1975 | Barron | 175/27 X |
| 4,324,387 | 4/1982 | Steinhagen | 254/377 |
| 4,434,971 | 3/1984 | Cordrey | 175/27 X |
| 4,593,773 | 6/1986 | Skeie | 175/170 X |
| 4,662,608 | 5/1987 | Ball | 175/27 X |
| 4,756,366 | 7/1988 | Maroney et al. | 166/385 |

*Primary Examiner*—Bruce M. Kisliuk
*Attorney, Agent, or Firm*—Marcus L. Bates

[57] ABSTRACT

Maximum rate of drill bit penetration in high speed coring is achieved by precise control of bit weight and bit speed. The automatic drilling system of this invention makes it possible to quickly reach and maintain this optimum combination or "sweet-point" each time the core bit is started. The required speed and weight is input into the system by the operator. A controller electronically senses the bit weight and provides instantaneous feedback to a hydraulically driven drawworks which is capable of maintaining a precise weight on the bit throughout varying penetration modes. The drilling system uses a combination of equipment that includes a hydraulic system for the control of the drawworks; a solid-state strain gauge load cell apparatus built into the swivel assembly for continuously weighing the drill string; an electronic load control circuitry for determining the bit weight, drill string weight, and for maintaining the bit weight control; and, a top drive system for high speed rotation of the string.

22 Claims, 9 Drawing Sheets

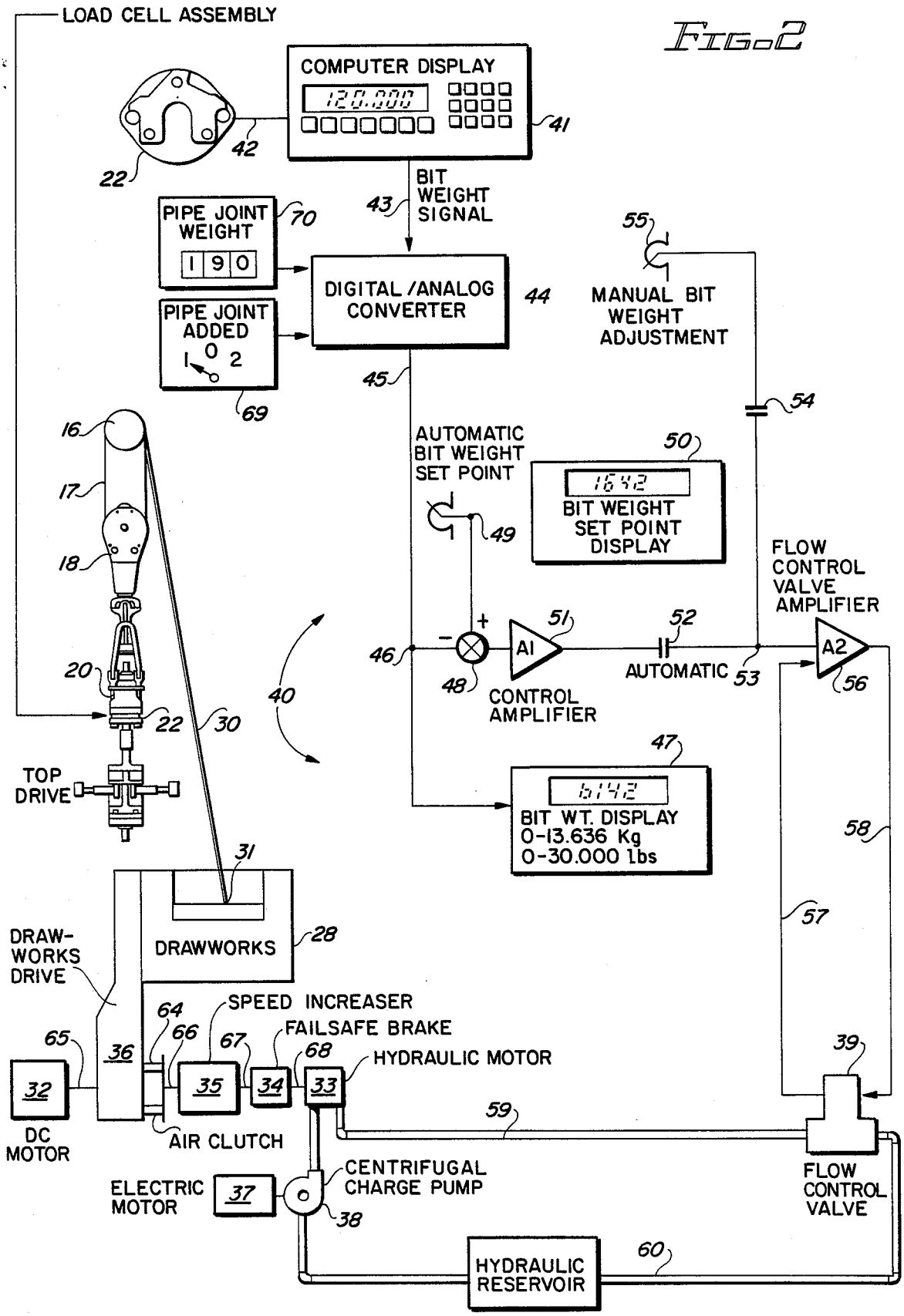
FIG. 2
LOAD CELL ASSEMBLY
COMPUTER DISPLAY
41
42
22
BIT WEIGHT SIGNAL
43
PIPE JOINT WEIGHT
70
190
PIPE JOINT ADDED
0 1 2
69
DIGITAL /ANALOG CONVERTER
44
MANUAL BIT WEIGHT ADJUSTMENT
55
54
45
AUTOMATIC BIT WEIGHT SET POINT
49
50
BIT WEIGHT SET POINT DISPLAY
FLOW CONTROL VALVE AMPLIFIER
16
17
18
20
22
30
40
46
48
51
A1
52
AUTOMATIC
53
A2
56
CONTROL AMPLIFIER
TOP DRIVE
47
BIT WT. DISPLAY
0-13.636 Kg
0-30.000 lbs
58
57
31
DRAWWORKS
28
DRAW-WORKS DRIVE
SPEED INCREASER
64
66
67
FAILSAFE BRAKE
68
HYDRAULIC MOTOR
65
36
32
35
34
33
39
59
DC MOTOR
AIR CLUTCH
CENTRIFUGAL CHARGE PUMP
ELECTRIC MOTOR
37
38
FLOW CONTROL VALVE
HYDRAULIC RESERVOIR
60

FIG. 9
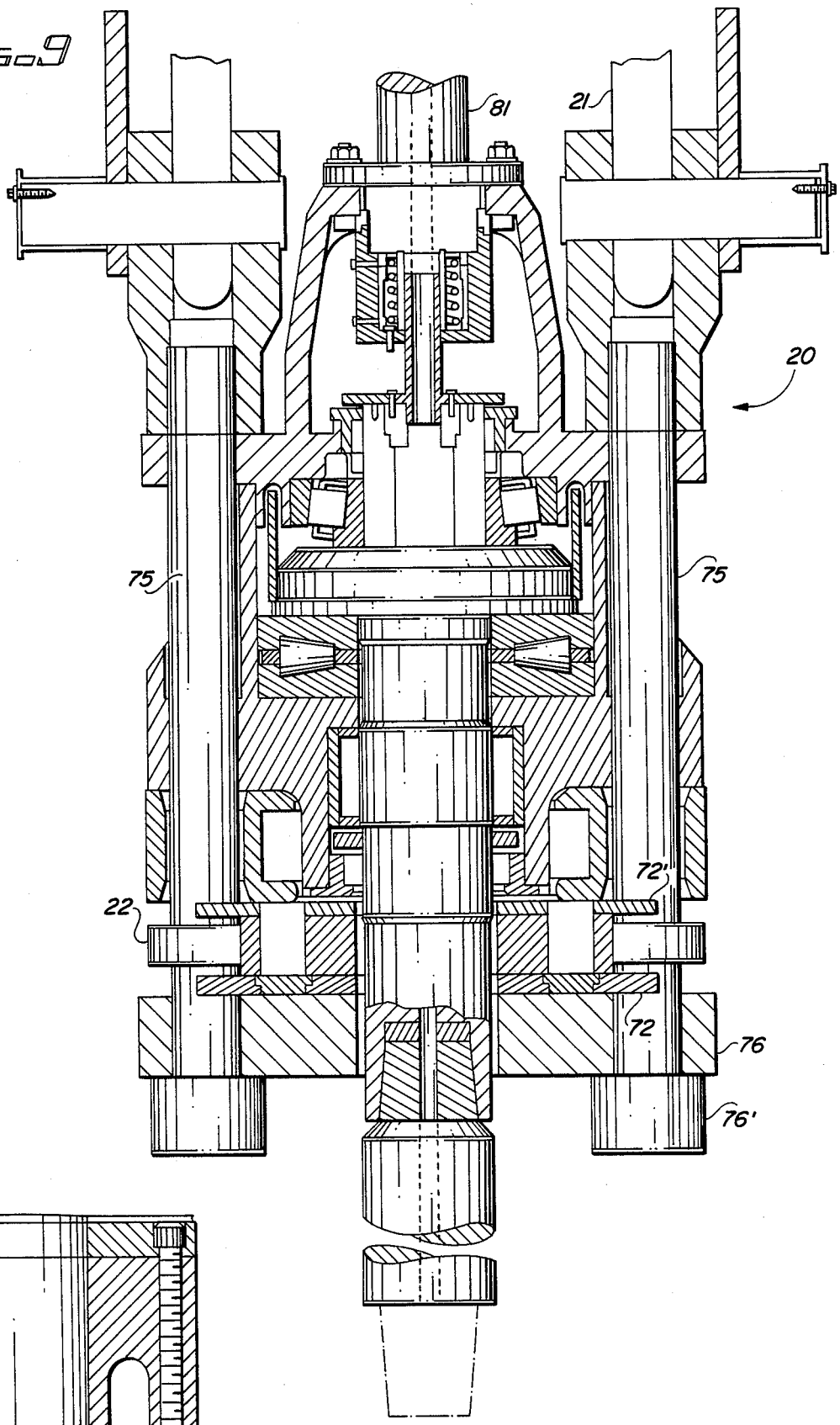
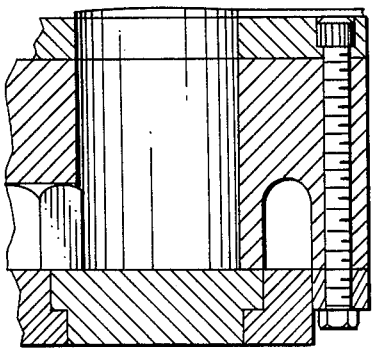
FIG. 8

AUTOMATIC DRILLING SYSTEM

This is a continuation of application Ser. No. 100,567, filed Sept. 24, 1987, now abandoned.

BACKGROUND OF THE DISCLOSURE

In a drilling rig having a full complement of drill pipe and tool joints connected in a drill string, the overall weight of the string is large compared to the desired weight at the drill or coring bit. In coring operations especially, the desired bit weight (WOB) can be as little as ½ of one percent of the total drill string weight. Using existing conventional weight indicators, the accuracy of sensing and controlling is prohibitive for maintaining the WOB within such a narrow range.

During the drilling of boreholes using a rotary bit, it is desirable to maintain a constant WOB because wide variations of the weight on the bit tend to wear out or damage the bit prematurely and therefore reduce the rate of penetration. Coring especially requires an accurate, constant sensing of the drill string weight to make possible a smoother braking of the block travel while drilling. The automatic drilling system of this invention controls the bit penetration rate within the operating range of 20 meters/hour to 0.7 meters /hour while maintaining a set bit weight. Given a definite bit weight set point between 0 and 15,000 Kg, the bit weight controller can maintain the bit weight within 200 Kgs. This is an unusual and unexpected result when it is considered that the drill string weight often exceeds 100,000 kg.

SUMMARY OF THE INVENTION

Optimum rate of drill bit penetration in high speed drilling is achieved by precise control of bit weight and bit speed. The present invention provides an automatic drilling system which makes it possible to quickly reach and maintain this optimum combination each time the bit is started. The required speed and bit weight is input into the system by the operator. A controller device electronically senses the weight on bit and provides instantaneous feedback of a signal to a hydraulically driven drawworks which is capable of maintaining precise bit weight throughout varying penetration modes.

A unique combination of equipment is used to accomplish these functions and includes a novel hydraulic system for the control of the drawworks; an unusual solid-state strain gauge load cells built into the swivel assembly; an electronic load control panel and circuitry for computing bit weight, drill string weight, and generating an automatic bit weight control signal; and, a top drive system that includes the above swivel and a motor that directly drives the drill string.

Drill string travel is controlled by a hydraulic motor connected to retard unspooling of the drawworks drum. The motor is connected to receive hydraulic fluid from an electrically-operated proportional flow control valve. The control valve reads an analog signal provided from the electronic circuitry, and restricts the flow of hydraulic fluid coming from the discharge side of the hydraulic motor in proportion to the control signal. The pressure on the motor creates a braking action on the transmission shaft which is being driven by the drawworks drum shaft.

An air clutch connects the drum braking system to the line shaft of a transmission. This air clutch engages only after the drawworks electric motors are switched off. The drilling line stripping off the drawworks drum becomes the driver, back driving the output shaft, the rotation of which is increased through a speed increaser to thereby minimize motor leakage and insure smooth braking with the hydraulic motor.

To insure a positive brake on the drum, a spring operated "parking brake" is installed between the speed increaser and the hydraulic motor. This brake is engaged whenever the hydraulic leakage through the motor will not stop the drum from rotating.

A load control is used to measure the total weight of the drill string and to ascertain the weight on the bit. The load cells of the strain gauge type are mounted to the lower end of the swivel assembly. The load cell assembly contains individual cylindrical load cells that are positioned symmetrically around the periphery of a special load cell holder. The weight of the drill string is distributed on each of the load cells whose electrical outputs are combined to produce the electrical signal representing the total drill string weight. The total weight signal is converted to a digital signal and displayed numerically.

To determine the weight on bit, the drill string is weighed and the total weight information is stored in memory just prior to the bit touching downhole and resuming the drilling operation. The total weight display continues to monitor the total weight of the string and a second display monitors the weight on bit. As soon as the bit touches down, the drill string weight is reduced since the tension in the drill string is reduced by the weight on bit. Thus, the total weight indicator decreases in value as this occurs.

The reduction in total weight represents the weight on bit, and this value is displayed on the digital meter. The output of the weight on bit is converted to an analog signal for use in the automatic control system.

To achieve automatic weight on bit operation, a reference voltage is established by the bit weight set point potentiometer, and compared with the weight on bit analog signal. The difference is amplified and used to control the valve to the hydraulic motor which acts to retard the downward movement of the drill string. The heavier the weight on bit, the greater will be the retarding action of the hydraulic motor until the desired weight on bit is achieved by the controller. Continuous adjustment of the electronic signal to the electro-hydraulic retarding motor keeps the weight on bit near the tolerance set by the set point potentiometer. Hence, the desired weight on bit and the actual weight on bit are kept within close range of one another.

A primary object of the present invention is to provide a means of controlling the weight on bit during a drilling operation by controlling the rate of descent of a drill string.

A further object of this invention is the provision of method and apparatus for continuously controlling the weight on bit during a coring operation using a rotary drilling rig.

Another object of this invention is to continuously weigh a rotary drill string, select a desired weight on bit, compare the two signals to provide an operating signal, using the operating signal to throttle a hydraulically actuated motor which provides the necessary torque to resist rate of downhole travel of a drill string to a value to achieve the desired weight on bit.

A still further object of this invention is to measure the drill string weight at the bottom of a swivel, and change the measurement into a signal which is modified to account for the desired weight on bit, and using the modified signal to throttle fluid flow through a hydraulic motor which is connected to control the rotation of a drawworks drum.

Another and still further object of this invention is to provide a load cell apparatus which is connected at the upper end of a drill string for continuously weighing the drill string.

An additional object of this invention is to provide an automatic drilling system that rotates a drill string at a predetermined rpm, while at the same time the drill string is lowered at a rate which maintains a predetermined weight on bit.

These and various other objects and advantages of the invention will become readily apparent to those skilled inthe art upon reading the following detailed description and claims and by referring to the accompanying drawings.

The above objects are attained in accordance with the present invention by the provision of a method for use with apparatus fabricated in a manner substantially as described herein.

BRIEF DESCRIPTION OF THE DRAWINGS

FIG. 2 is a part diagrammatical representation which schematically sets forth a drilling system made in accordance with the present invention;

FIG. 8 is a cross-sectional view taken along line 8—8 of FIG. 7;

FIG. 9 is an enlarged, detailed, cross-sectional view of the apparatus disclosed FIG. 7;

DETAILED DESCRIPTION OF THE PREFERRED EMBODIMENT

Figure 1:
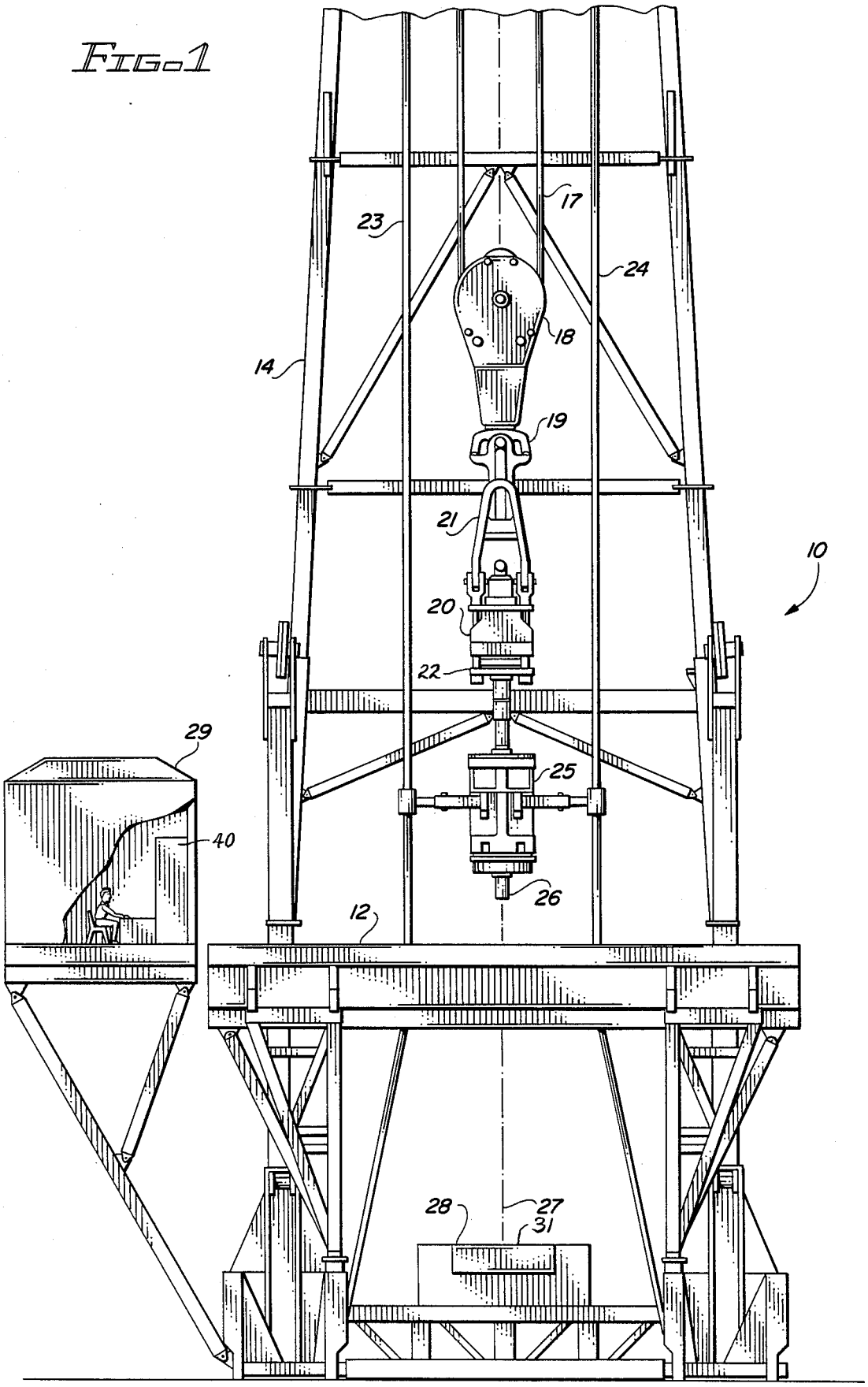
FIG. 1 is a fragmentary, part schematical, part diagrammatical side view showing a rotary drilling rig having associated therewith an electro-mechanical system by which part of the present invention is carried out.

In FIG. 1 of the drawings there is disclosed an automatic drilling operation and system 10 made in accordance with the present invention. The system is illustrated in conjunction with a drilling rig having a rig floor 12, derrick 14, crown block 16, strands of a cable 17, by which the traveling block 18 is vertically positioned. Lower end 19 of the traveling block is connected to the upper end of the swivel 20. The swivel has a bale 21 by which it is supported from the connector 19.

A load cell assembly 22, made in accordance with the present invention, is positioned in underlying relationship respective to the remainder of the swivel 20 so that the load cell assembly is supported from a position immediately below the swivel. This enables the entire weight of the drilling string to be carried by the load cell assembly; as will be more fully pointed out later on herein.

Parallel cable guides 23, 24 are spaced from one another with the opposed ends thereof being connected between floor 32 and a suitable upper part of the derrick. An electric drilling motor 25 has a hollow output shaft 26 that directly drives a drill string 27. The motor 25 has the illustrated opposed arms attached to the motor frame with the free ends of the arms being slidably connected to the cables 23, 24 so that as the traveling block 18 moves vertically within the derrick, the swivel, motor, and drill string 27 are carried therewith. The arms and cables are designed to resist the reaction of the motor and drill string. The drawworks drive 28 is positioned to accept the marginal end of support cable 17 about a drawworks drum as is more particularly illustrated in FIG. 2. A dog house 29 houses control panels and electronic circuitry for controlling the operation of the drilling rig.

In FIG. 2, fast line 30 extends from drum 31 of draw works 28 and is rove at 17 between the crown block 16 and traveling block 18. A drawworks motor 32, hydraulic motor 33, failsafe brake 34, and speed increaser 35 are all arranged respective the drawworks drive 36 to enable the drawworks drum 31 to be controlled in a new and novel manner, in accordance with the present invention, as will be more particularly pointed out hereinafter.

A 3 H.P. motor 37, drives a centrifugal charge pump 38 which discharges into the inlet of hydraulic motor 33. The hydraulic motor is controlled by a flow control valve 39, which throttles flow of hydraulic fluid flowing from motor 33, thereby controlling the rotational speed of motor 33.

Numeral 40 broadly indicates circuitry that is interposed between load cell assembly 22 and flow control valve 39 for throttling the valve in order to maintain a constant WOB. Computer 41 is an analog model 5316 Load Cell Digitizer. Conductors 42 ar interconnected to load cell asembly 22 and provide a signal to the computer 41 which is related to the weight of the entire drill string 27, as measured at the lower end of th swivel asembly 20.

The computer outputs a bit weight signal which is connected by conductor 43 to the illustrated digital analog convertor 44. The output from the digital analog convertor is conducted along path 45 to junction 46, to provide a bit weight display 47 with a signal directly related to bit weight. At the same time the signal from convertor 44 is summed at 48 with a signal from an automatic bit weight set point 49, to provide an operating signal.

The automatic bit weight set point 49 displays its selected value at bit weight set point display 50. This is the desired WOB that is set by manipulating the device 49. The actual WOB that is derived from the measurement at 22 and is displayed at 47. Any difference that may exist between 47 and 50 is calculated at 48, amplified by the control amplifier 51, and travels through the automatic switch 52, to junction 53. The indicators 47 and 50 are Model 200B manufactured by D.C.I., Inc. These are analog input instruments that derive their signal from the output at 46 and 49.

Manual switch 54 is connected to the illustrated manual bit weight adjustment 55, and provides a means by which manual control can be effected over the flow control valve 39. Both switch 52 and switch 54 are independently actuated from the panel.

The signal continues from junction 53 to the flow control valve amplifier 56, which is a type VT5004 Electronic Amplifier for controlling directional proportional valves with electrical spool position feedback, available from Rexroth. The signal is treated to make it compatible with the circuitry of control valve 39'. The signal from 56 travels along conductors 57, 58 and controls the action of the electrical components of the flow control valve 39'.

Flow conduits 59 and 60 connect the control valve 39 with the illustrated hydraulic reservoir, centrifugal charge pump 38, and hydraulic motor 33. The flow control valve 39 throttles the flow from the hydraulic motor 33 in accordance with the magnitude of the signal received from the flow control amplifier 56.

Figure 3:
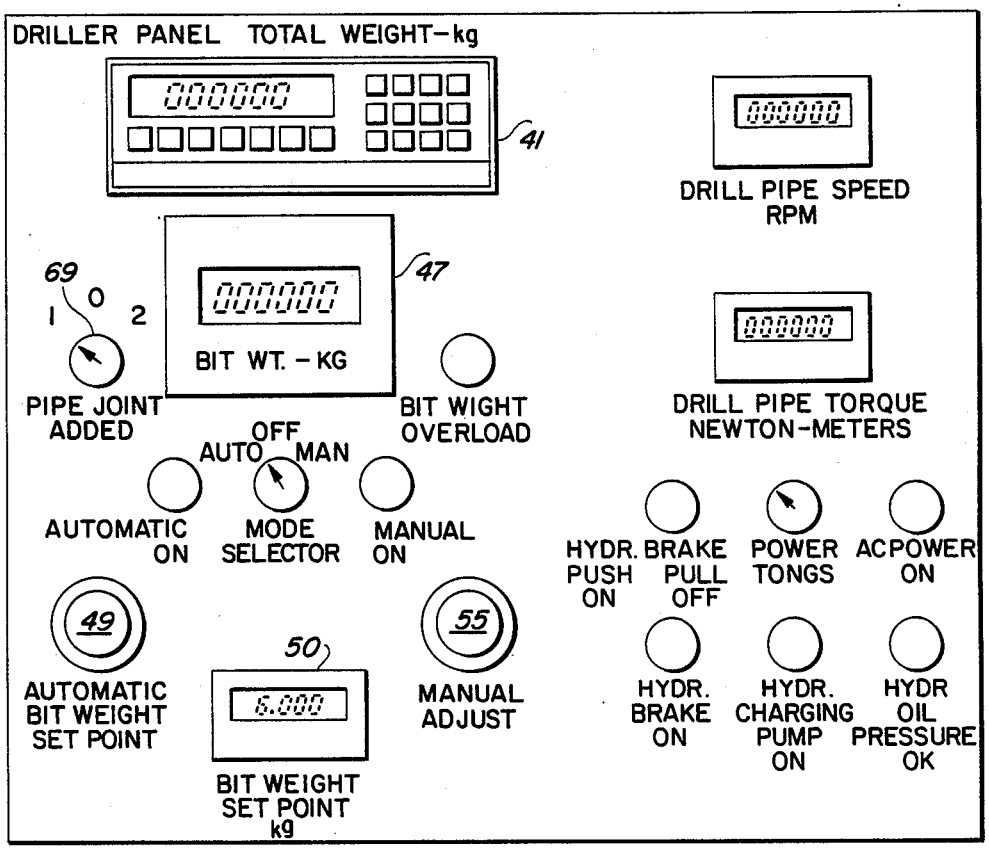
FIG. 3 is an enlarged plan view of the front of a console used in conjunction with the present invention.

FIG. 3 shows the preferred form of the driller panel, wherein some of the various components of the electronic circuitry are enclosed.

Figure 4:
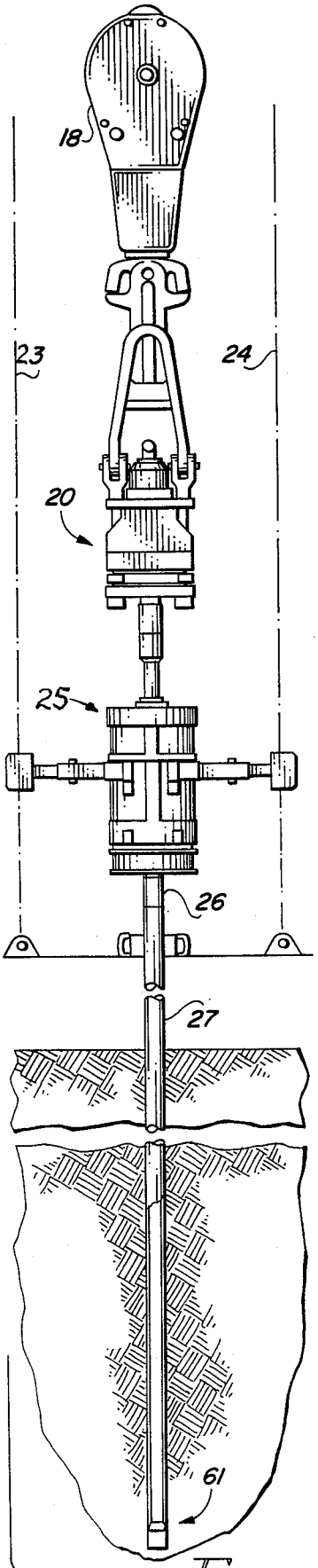
FIG. 4 is an enlarged, more detailed view of part of the apparatus disclosed in FIG. 1.

In FIG. 4 it will be noted that the hollow output shaft 26 of motor 25 is directly connected to the drill string 27 which in turn is connected to a drill bit at 61. The bit has not been set down on bottom. Drilling mud flows into the swivel 20, through the swivel and through the hollow motor shaft 26, and to the bit. The drill bit illustrated herein is preferably a diamond coring drill bit having a prior art core barrel associated therewith by which approximately 90 feet of continuous unbroken core is to be obtained from the formation being penetrated by the drill bit.

Figure 5:
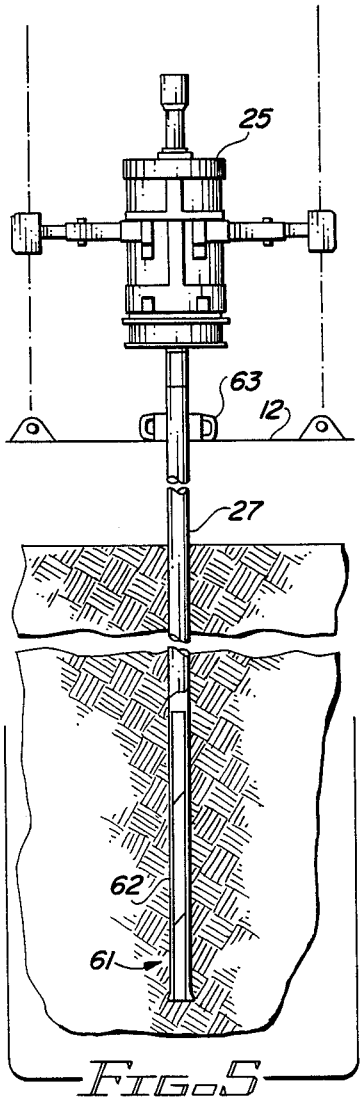
FIG. 5 is a fragmentary view showing the apparatus of FIG. 4 in another configuration.

FIG. 5 illustrates the drilling operation as the continuous core 62 is being formed by the bit and is received within the core barrel. Numeral 63 indicates a set of conventional slips or side door elevators received within a slip bowl, or the like, located at floor 12 of the drilling rig.

Figure 6:
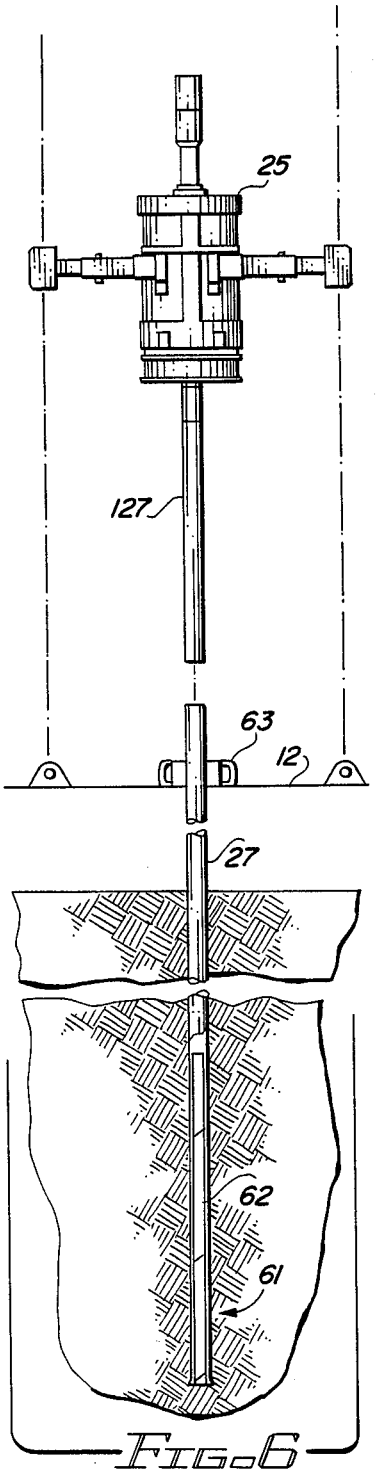
FIG. 6 is similar to FIG. 5 and shows an alternate configuration thereof.
Figure 10:
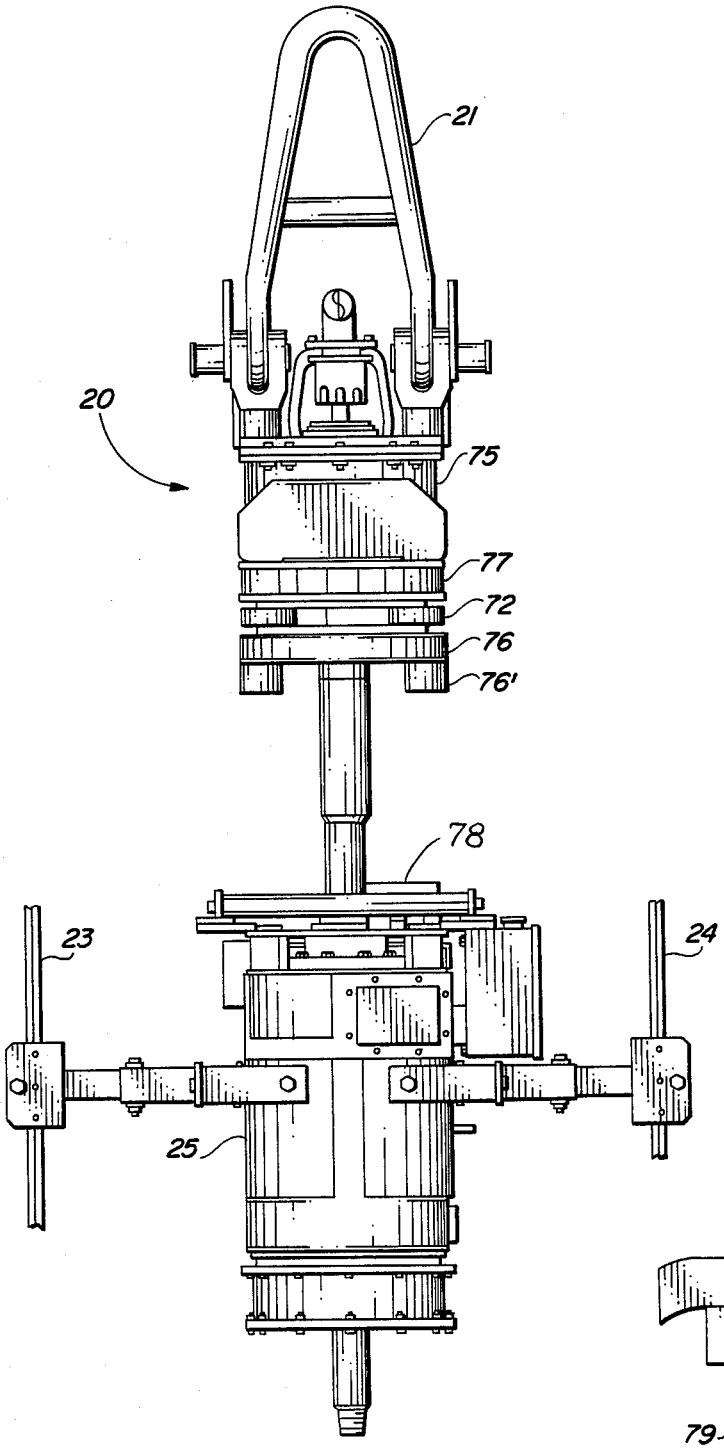
FIG. 10 is an enlarged, elevational view of part of the apparatus disclosed in FIG. 1.
Figure 11:
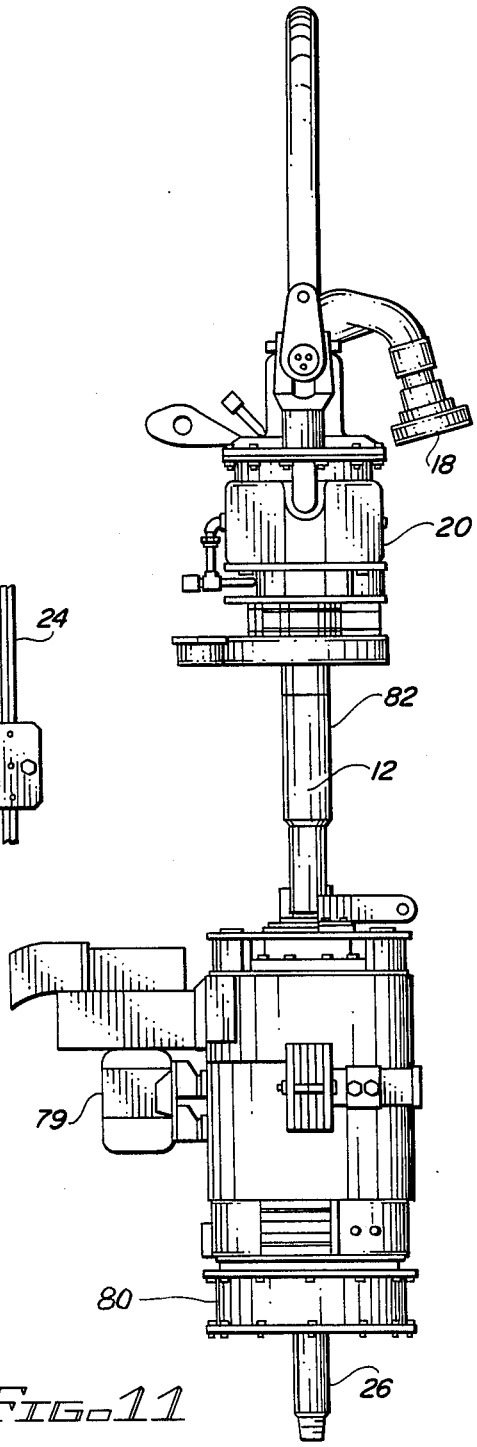
FIG. 11 is a side view of the apparatus disclosed in FIG. 10.
Figure 12:
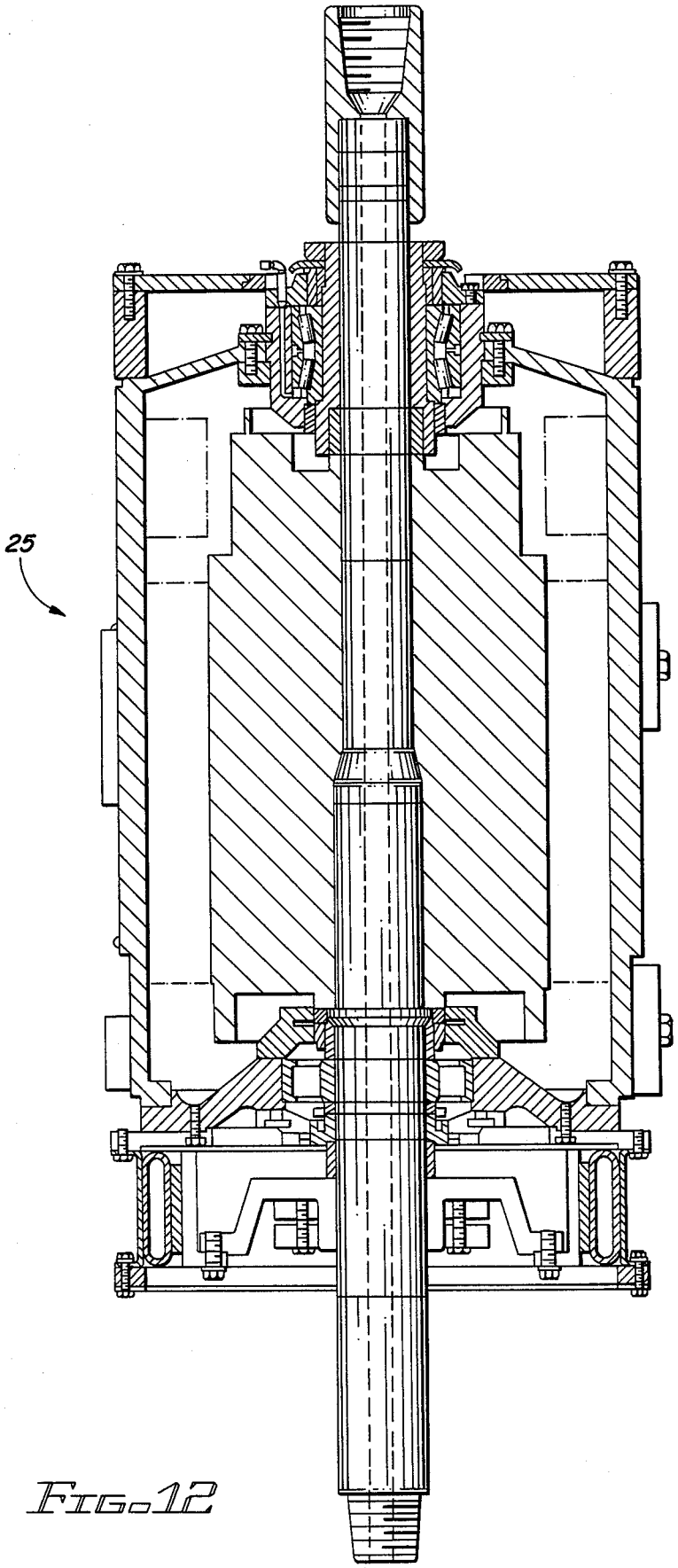
FIG. 12 is an enlarged, cross-sectional view taken along line 12—12 of FIG. 11.

FIG. 6 illustrates the drill string 27 being held by the slips 63 while an additional 30 foot pipe joint 127 is connected into the drilling string 27 so as to add additional length thereto. Note the unbroken core attached to the formation and extending up into the core barrel. Note, the bit is on bottom.

In FIG. 2, numerals 65, 66, 67 and 68, respectively, indicate drive shafts by which the DC motors 32, speed increaser 35, failsafe brake 34, and hydraulic motor 33, respectively, are connected to the drawworks drive 36. The air clutch 64 arrests rotation of the drawworks drum 31 whenever the clutch is engaged. The DC motors 32 are comprised of several large motors harnessed together to suitably power the drawworks drive 36. The motors 32 are clutched to the drawworks and used for making trips into and out of the hole, and therefore is connected to power the draw works drive whenever it is desired to spool the cable 30 onto drum 31. Speed increaser 35, failsafe brake 34, and hydraulic motor 33 are connected to the draw works drive 32 by means of clutch 64 for controlling the rotation of drum 31 in accordance with the present invention.

Numeral 69 is a pipe joint added apparatus which accounts for the number of added pipe joints (127 of FIG. 6), while numeral 70 is an indicator showing the accumulated weight of the additional pipe joints 127 that have been connected into the drilling string 27.

Figure 7:
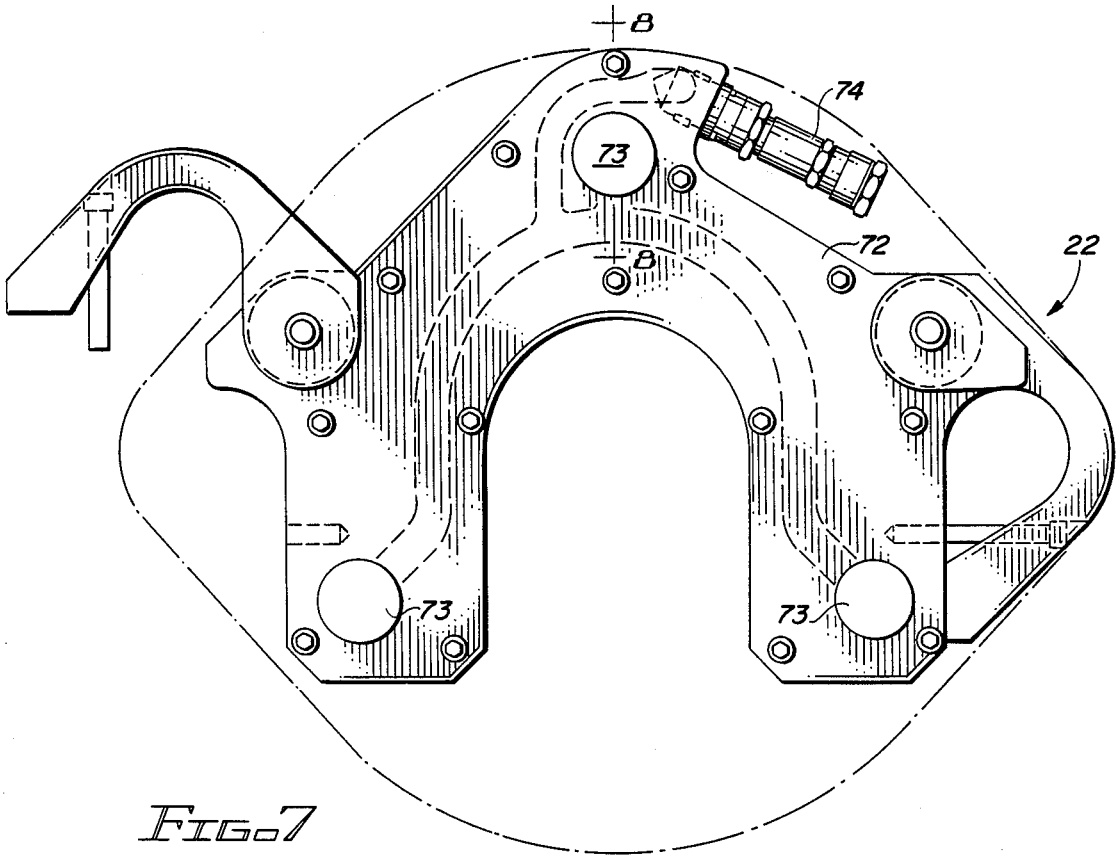
FIG. 7 is an enlarged detailed view of part of the apparatus disclosed in some of the foregoing figures.

FIGS. 7–9 set forth the additional details of the load cell assembly 22. The assembly 22 includes a built up frame 72 within which there has been formed three cavities 73 equally spaced apart. The individual load cells are received within the cavities, and each load cell is connected to electrical connector 74 which in turn is connected to the electrical conduit 42 of FIG. 2.

The frame member 72 is mounted in supported relationship immediately below the swivel main body by means of the illustrated two parallel vertical load carrying members 75 of FIG. 9. The load carrying members extend through the frame member and have an enlargement at the lower end thereof that is brought into engagement with the bottom of the frame member 72 while a top plate member 72' bears the load of the entire drill string, thereby placing the load cells in compression between the two confronting plate members, 72 and 72'.

OPERATION

Figure 13:
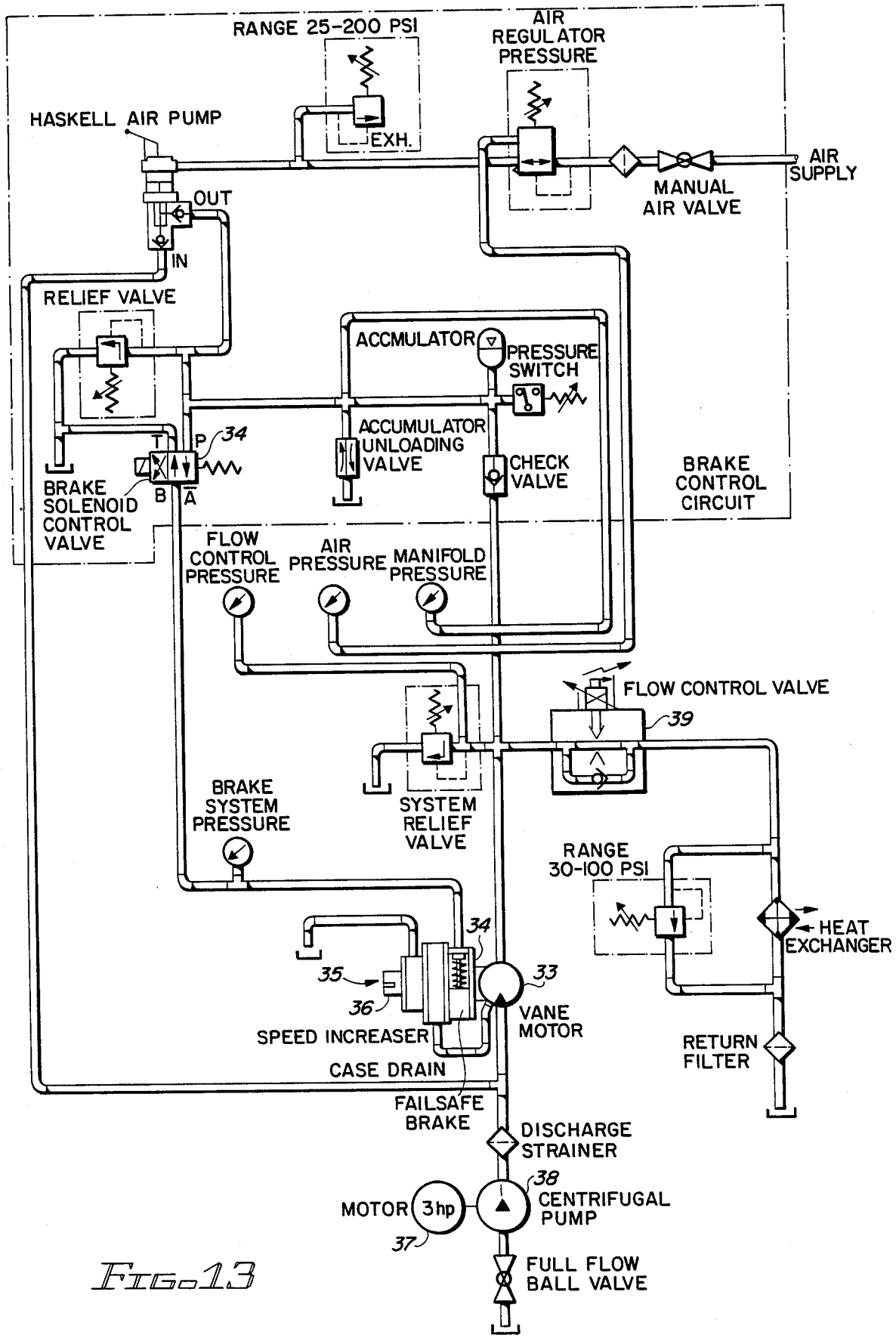
FIG. 13 is a part schematical, part diagrammatical representation of a hydraulic system for use in carrying out in the present invention; and, FIG. 14 is a part schematical, part diagrammatical representation of an air control system for use in carrying out the present invention.

In operation, the drill string travel is controlled by an electrically operated, proportional flow, control valve 39 (see FIGS. 2 and 13). The control valve 39 has means for reading an analog signal from the electronic load control panel which is processing a signal from the compression load cells in the swivel assembly. By restricting the hydraulic fluid coming from the discharge side of the hydraulic motor 33, the resultant pressure creates a braking action on the transmission shaft 68 which is being driven by the drawworks drum shaft; ie, the drum is spooling cable and this drives the drum shaft which in turn drives shafts 66–68, and motor 33.

The hydraulic system of FIGS. 2 and 13 uses a vane type motor 33 to pump the fluid to the proportionally operated flow control valve 39. The motor 33 is charged by the centrifugal pump 38 taking fluid from the hydraulic reservoir. As the fluid passes through the motor, work is done on the fluid so it picks up heat that has to be removed by a heat exchanger.

Control of the failsafe hydraulic brake 34 is an additional novel function of the system. In FIG. 13, the brake control circuit works off the main manifold, which is pressured from three sources. The primary source is the Haskel Air Pump which pumps oil (by air pressure) at 36 times the input air pressure (30 psi). A secondary pressure source is the diaphram accumulator which holds a 500 psi precharge and 15.0 cu. in. volume. Since the brake will require about 4 cu. in. of fluid to operate, the accumlator has sufficient capacity to operate the brake several times. As the autodriller works the heavier loads, the system pressure will be elevated above 1100 psi. During these conditions, the system pressure will be higher than the manifold pressure, therefore, the check valve will open and charge the accumulator with hydraulic fluid. The manifold now becomes a common pressure source for operating the failsafe brake 34. The manifold pressure must be above 300 psi for the brake to operate. To insure that this minimum pressure is maintained, a pressure switch is installed in the manifold that operates a green light on the control panel. When this light is on the manifold pressure is high enough to operate the brake controls.

The brake itself is controlled by the brake solenoid control valve. This valve takes its controlling signal from two sources. Under the normal drilling mode, the brake is hydraulically released and applied by the electronic amplifier and relay logic circuit, located in the control panel. When the motor is stalled and only the cross-port leakage is going through the flow control valve (2 volt signal) the electronic control circuit activates the brake solenoid control valve and dumps the hydraulic fluid to tank, thereby engaging the brake. At any time the brake may be applied or released by the push button mounted in the control panel. Additionally, if there is a loss of hydraulic pressure for any reason, the brake will engage, stopping the drill string from "making hole"; ie, the drum 31 is prevented rotating due to actuation of failsafe brake 34, FIGS. 2 and 13, so the drill string cannot descend.

The main operating conditions are monitored by green lights located on the control panel of FIG. 3. To be "making hole" or penetrating, all the green lights must be lit. The hydraulic oil pressure must be above 350 psi, the hydraulic brake must have hydraulic fluid on it in order to release the brake, and the centrifugal pump 38 must be operating to charge the intake of hydraulic motor 33.

The air control system (see FIG. 14) plays a very important role within the automatic drilling system. Air pressure is used to provide both manifold hydraulic pressure for brake control 34 and the main clutch 64 control system. Since the rig air system is vital, a low pressure alarm is included in the drillers console. The alarm is activated whenever the pressure is less than 70 psi.

Figure 14:
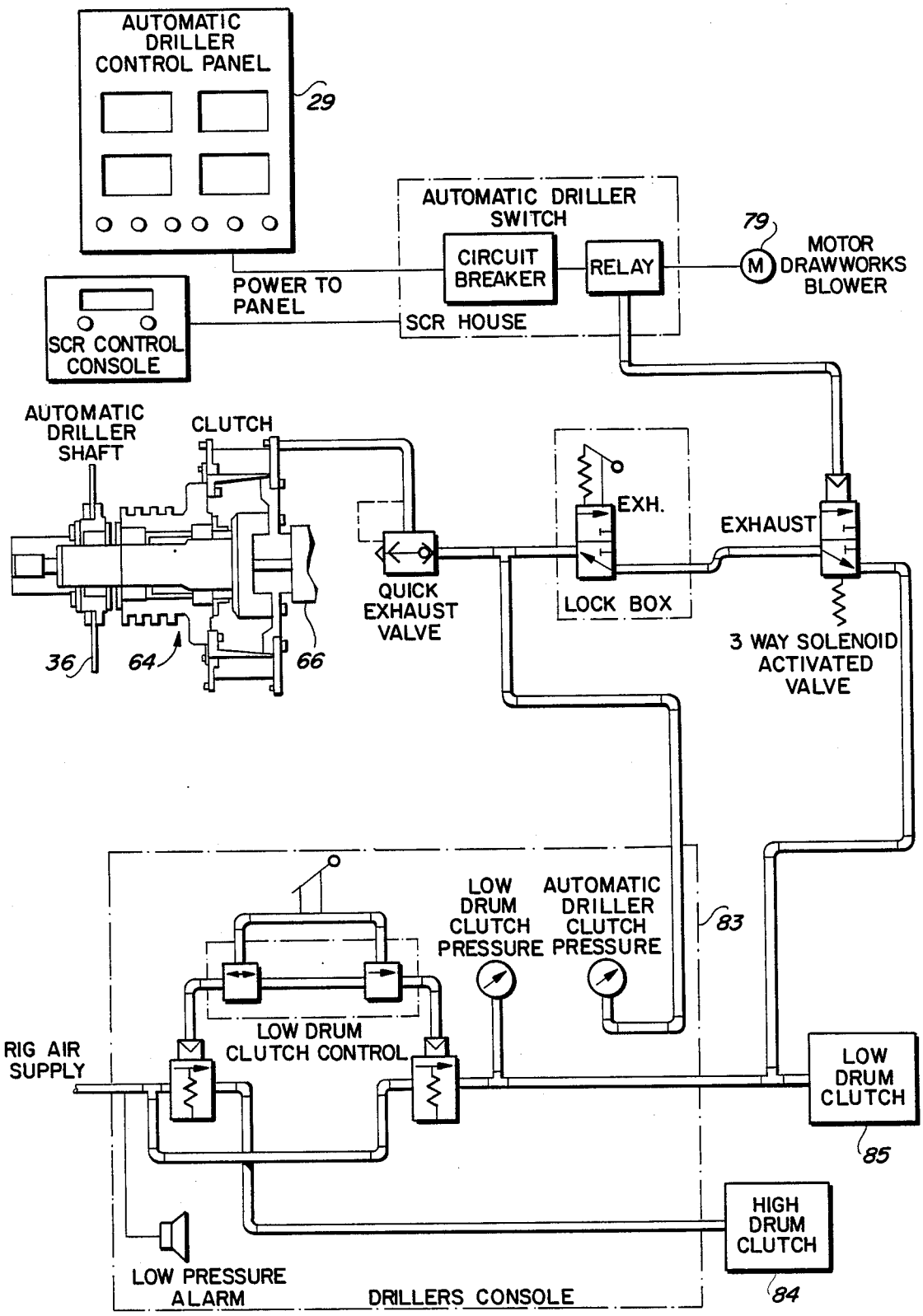

As seen in FIG. 14, the power to the autodriller comes through a circuit breaker located in the SCR control house 29. Whenever the coring operation starts, the autodriller can be engaged from the drillers console (FIG. 3) by switching off the DC motor blowers 79 and clutching the low drum clutch 85. The low drum clutch air supply also provides the air for the automatic driller clutch 64.

When the blower motor is off, the brake solenoid control valve 34' (FIG. 13) is de-energized and air is supplied to the clutch 64. When the driller wants to lift the drill bit off bottom, he switches the blower motors on and the relay trips, energizing the brake solenoid control valve, which exhausts the air from the autodriller clutch 64. This clutch release will enable the DC motors 32 to be used to lift the drill pipe by means of the drawworks drive 36 since apparatus 33, 34, 35 are disengaged from the drawworks drive by means of air clutch 64.

This particular valve 34' of FIG. 13 was selected as a safety feature. In the event of a power failure or a defective solenoid, the valve will be deenergized, providing air to the clutch 64. Air on the clutch keeps the hydraulic system 33, 38, 39 in control of the drilling-line 30; if the clutch looses air while drilling, the traveling block 18 will fall uncontrolled until the drum brakes can be applied.

When the rig is used for conventional drilling, the power to the autodriller and to the relay is off, this will deenergize the solenoid, blocking the rig air from the clutch. A two position, three way valve is used to insure that the clutch 64 cannot inadvertently be pressurized while drilling conventionally.

When the automatic drilling system is engaged, the manual brake handle for drum 31 is up, ie, released. At this time the drum braking is totally dependent upon the autodriller. The drum braking systen, as seen in FIG. 2, is now comprised of motor 33, brake 34, and speed increaser 35, all of which are connected to the line shaft of the two speed transmission (not shown) through the air clutch 64 (see FIG. 14). This clutch engages only after the electric motors 32 are swithed off. As the drill string moves downhole, the drilling line 30 is stripping off the drum 31 and therefore becomes the driver, back driving the output shaft. The rotation is increased through a speed increaser 35 to minimize the effects of motor leakage and insure smooth braking. The heat generated by the braking action is carried in the hydraulic fluid from the motor 33, to the flow control valve 39, to an air blast heat exchanger (not shown).

To ensure a positive brake on the drum 31, a spring operated failsafe brake 34 provides a "parking brake" and is installed between the speed increaser and the hydraulic motor. This brake will engage at the point where the hydraulic leakage through the motor will not stop the drum from rotating.

LOAD CONTROL SYSTEM

The primary purpose of the load control system is to measure the total weight of the drill string and ascertain the weight on the bit. To achieve this, load cells of the strain gauge type are mounted integral to the swivel assembly. The load cell assembly contains three individual cylindrical load cells that are positioned symmetrically around the periphery of the load cell holder. The weight of the drill string is distributed on each of the three load cells whose electrical outputs are combined to produce the electrical signal at 42 representing the total weight of the drill string. The electrical output is obtained directly from a single connector located in the load cell assembly. The load cell assembly is accurate to within 200 Kg at 150,000 Kg total weight.

The total weight signal is transmitted through a multi-conductor, shielded cable to the computer 41, where the signal is converted to a digital signal and displayed on the illustrated total weight display at 41.

To determine the weight on bit, the total weight information is removed from a memory unit, leaving the contents of the memory at zero when the reset pushbutton is pressed. This reset operation is performed just prior to the bit touching downhole and resuming the drilling operation. The total weight display (see FIG. 2) continues to monitor the total weight at 41 and the second display 47 is available to monitor the weight on bit. As soon as the bit touches down, the drill string weight is reduced since the tension in the drill string is reduced by the weight on bit. Thus, the total weight indicator will commence to decrease in its value when bit contact occurs.

The reduction in total weight is therefore the weight on bit and this value is displayed on the digital meter 47. The output of the weight on bit is converted to an analog signal for use in the automatic control system.

To achieve automatic weight on bit operation, a reference voltage is established by the bit weight set point potentiometer 49. This is compared at 48 with the weight on bit analog signal and the difference is amplified at 51. This amplified signal is sent to the flow control valve amplifier which controls the flow control valve 39 for the hydraulic motor, forcing the motor to retard the downward movement of the drill string. The greater or heavier the weight on bit, the greater will be the retarding action of the hydraulic motor 33 until the desired weight on bit is achieved by the system. Automatic adjustment of the electronic signal to the electro-hydraulic control for the retarding motor 33 is maintained to keep the the weight on bit near the value set by the set point potentioneter 49.

In the event manual control of this retarding action is desired, the mode selector switch of FIG. 3 can be switched to manual and operation of the system is at the discretion of the operator. The total weight display at 41 and weight on bit display at 47 will continue to function to guide the operator as he operates the manual control potentiometer 55. The manual potentiometer indirectly opens and closes the flow control valve allowing the drill string to descend at a controlled rate.

A preset overload alarm is established within the controller to provide an indication that the weight on bit has exceeded safe limits. When this occurs, the operator can either reduce the weight on bit set point, switch to manual control, or press the emergency stop pushbutton to cause the retarding hydraulic motor to reduce the downward travel of the drill string to a minimum.

TOP DRIVE SYSTEM

The top drive assembly comprises the swivel assembly, DC drive motor, tool joints and associated equipment. The purpose of the top drive assembly is to provide variable speed power to the drill string and bit. Mounted as an integral, direct drive unit to the drill string, the 800 HP DC motor is suspended from the swivel assembly and allowed to turn freely at a top speed of 600 rpm. The frame of the motor is secured to suspension cables 23, 24 and not allowed to rotate when the motor is under powered conditions.

The power to the DC series-type motor 20 is obtained from the variable voltage, variable current, SCR power supply. The output of the SCR unit is up to 750 volts DC, 800 ampers, and can be adjusted over the full range down to 0 volts. Display of the speed and torque for the top drive and direct driven drill bit is provided on the automatic drilling control panel. The speed information is obtained from a magnetic pickup speed sensor 78 located to sense the drill string speed directly. The output of the speed sensor is sent to the digital display where the speed is indicated directly in RPM.

The torque of the top drive is obtained from a DC current sensor (Hall Effect Device (located in series with the DC cable of the top drive motor. The output of the HED is sent to the digital display where the motor torque is displayed in Newton-Meters The chart recorder is essential in determining the "sweetpoint" since it provides complete and accurate historical operating data. Bit penetration performance can be analyzed as it relates to the actual weight, speed and depth attained during coring activity.

EXAMPLE

The following is one specific hypothetical example of practicing the method of the present invention:

To perform the initial setup for the automatic drilling system, the following procedure must be done;

1. Turn on AC power in SCR house, auto driller control, charge pump, and swivel lube system. Wait 15 seconds.
2. Turn on the air supply valve for auto driller clutch (located on the compound near the clutch).
3. Set the automatic bit weight set point and the manual adjust knobs to minimum.
4. Set mode selector to "off" position.
5. Set auto driller brake by pushing in push button.
6. Confirm charging pump and hydraulic pressure lamps are on.

At this time, the status and position of the following devices on the front of the controller panel should be as follows:

Assume that the drilling operation has been going on for several hours and now is interrupted to obtain several continuous core samples. A core bit and a suitable coring barrel are attached to the bottom of the string. Joints of pipe are added into the string until the bit is just off the bottom of the hole.

At this time the total weight indicator will measure drill string weight. Let it be assumed that the total weight indicator (TWI) is 120,000 Kg while the maximum BWI instrument reading is 16,600 Kg. Using the drillers console, the following operations are carried out:

1. Driller should check to make sure the hydraulic brake push button is pushed IN.
2. Driller will set drawworks drum brake.
3. Switch off drawworks blower motors (switching off the blower motors will activate the automatic driller clutch).
4. Switch SCR assignment to top drive.
5. Set top drive rpm (top drive rpm is on the control panel).
6. Release drum brakes and return to the control panel.

Now it is necessary to establish weight into memory and set bit on bottom. This is achieved by pushing the tare and gross net weight buttons on TWI device, so that the TWI reading changes from zero to a TWI reading of 120,000 and a BWI reading of 0.

Next set the manual adjust knob 49 to zero and then pull the hydraulic brake button. Next, open the manual adjust knob until the flow control valve 39 allows the drill string to descend. The manual adjust knob is used to gently set the bit on bottom without bouncing the bit. Watch the weight on bit until desired bit weight is displayed. For example, the TWI reading may equal 115,000 Kg while the BWI reading equals 5,000 Kg.

Next, the manual adjust knob is set to the minimum setting and the hydraulic brake will engage, preventing any further bit penetration. With a weighted core bit on bottom and the top drive system turning to the right the required rpm, switch the mode select switch to "automatic". Slowly increase the automatic bit weight set point knob to the desired weight as shown on the bit weight set point indicator. When this is done, the hydraulic brake system will allow the drill bit to lower and seek its optimum rate of penetration or operating position. The bit weight indicator (BWI) will closely match the bit weight set point indicator as the system seeks to maintain the selected bit weight. If a change in bit weight is desired during the coring operation, the automatic bit weight set point knob can be readjusted as desired.

The bit weight overload light is an indication of the weight on bit exceeding the automatic set point weight. This can be programmed into the controller.

When the first 30 foot core has been made and the first 30 foot pipe joint has been drilled down, press hydraulic brake push button to engage hydraulic brake (see FIG. 3). At this time, adding pipe and setting slips is necessary. Note that the drill bit cannot be lifted off bottom without breaking the core, therfore, in order to set slips the upper end of the string must be lifted just enough to slide the side door elevators into position. The lift distance should be as small as ½ inch which will not change the position of the bit at all due to the elasticity or elongation of the drill string. The WOB will change but the bit face will remain in contact with the bottom of the hole and the core sample will stay intact. The driller can drill down very close to a location determined by the connection and the height of the side door elevators. The following is carried out:

1. Switch SCR assignment from top drive to the drawworks and kill the pumps.
2. Set the side door elevators in position and set the pipe down.
3. Use power tongs to break connection and spin out of the joint.
4. Make a mouse hole connection as follows:
   a. Just before setting slips (example only) the TWI reading may be 100,000 Kg while the BWI reading is 6,000 Kg, so that gross weight in memory initially equals 106,000 Kg.
   b. Setting on side door elevators, the drill pipe weight is off load cells, so the TWI reading may be 8,725 Kg while the BWI reading is 16,600 Kg and the gross weight in memory remains 106,000 Kg.

Pick up next tool joint that is to be added to the drill string. The tool joint weight will show as being added to the total weight indicator (TWI). The bit weight indicator (BWI) will not change.

Correct the bit weight calculation: Since the drill string cannot be lifted off bottom without breaking the core, a new weight cannot be determined and stored in memory. Each additional pipe joint weight must therefore be added for correct bit weight as follows:

a. When the first 30 foot pipe joint is added to the drill string, the pipe joint added selector switch (FIGS. 2 and 3) should be set to "1" to compensate for this additional weight.

b. When the second 30 foot pipe joint is added to the drill string, the pipe joint added selector switch should be set to "2" to compensate for this added weight.

c. When the core barrel is removed, reweigh the pipe load as noted above.

When using power tongs for the pipe makeup connection, make the connection then check the hydraulic brake to insure that the knob is pushed in.

Drillers console operations as follows:

a. Driller will gradually low clutch the drum and release the drum brakes to easily lift the pipe off the slips so that the elevators can be removed from the bowl without lifting the bit off the bottom.

b. Set the drum brakes (not shown).

c. Switch off drawworks blower motors.

d. Lock in low drum clutch (activate autodriller clutch).

e. Watch air pressure gages for low drum clutch and autodriller clutch.

f. Switch SCR assignment to top drive.

g. Set top drive rpm.

h. Release drum brakes and return to panel operation.

Panel operations:

a. Pipe joint added selector switch should be set to "1" or "2" depending on which joint has been added while working on this particular core barrel.

b. Disengage the automatic driller brake (pull out button).

c. If the mode selector switch is left on "auto" and the bit weight set point has not been changed, the unit will start seeking immediately and all the appropriate lights will be on, indicating proper operation.

We claim:

1. In a drilling operation wherein a drilling rig supports a drill string by a cable spooled onto a drawworks drum, a drawworks motor connected to rotate said drum for spooling and unspooling the cable and thereby lifting and lowering a drill string, a drawworks brake for braking the drum, and means for rotating a drill string which has a drill bit at the bottom thereof for penetrating a formation while fluid flows through a swivel located at the upper end of the drill string and through the string downhole to the bit; the method of controlling the weight on bit comprising the following steps:
   (1) weighing the drill string while the drill string is suspended within the borehole with the bit off bottom and generating a signal which is proportional to the drill string weight;
   (2) selecting an optimum value for the weight on bit as the bit is rotated while making hole;
   (3) modifying the signal of step (1) by combining said selected value of step (2) therewith to thereby provide a signal representative of the drill string weight required to achieve the weight on bit of step (2);
   (4) treating the resultant signal obtained in step (3) to provide a control signal which is proportional to the drill string weight required to achieve the weight on bit of step (2);
   (5) continuously supporting the drill string during a drilling operation by applying a variable rotational force on said drawworks drum by connecting a motor means to be rotated by the drawworks drum as the drum unspools cable therefrom; and, applying power to said motor means to drive said motor means in opposition to the unspooling of the drawworks drum; and,
   (6) controlling the torque that said motor means applies to resist rotation of said drum by applying power to said motor means in proportion to said control signal of step (4) to thereby cause the motor means to apply a rotational force to the drum that continually approaches a constant weight on bit which is equal to the selected value of step (2).

2. The method of claim 1 and further including the step of using a hydraulic motor for said motor means and connecting the hydraulic motor to a source of power fluid through a control valve means and throttling the control valve means as may be required to achieve said rotational force on said drum and thereby apply an upward force on said drill string.

3. The method of claim 2 and further including the steps of weighing the drill string by placing load cells in the lower end of the swivel, supporting the swivel with said cable, and supporting the drill string fromthe load cells to thereby place the load cells in compression with a force equal to the tension in the upper end of the drill string.

4. The method of claim 3 and further including the steps of rotating the upper end of the drill string by direct coupling to a direct drive motor having a hollow shaft which is supported in underlying relationship respective to the swivel and forms part of said drill string; and, flowing drilling fluid through the swivel, through the hollow shaft of the direct drive motor, and down through the drill string to the bit.

5. The method of claim 2 and further including the steps of rotating said drill string with a direct drive motor; and, carrying out step (1) by weighing said drill string at a location adjacent to the upper end of said direct drive motor.

6. The method of claim 1 and further including the step of using a fluid actuated motor for said motor means, connecting said fluid actuated motor to be driven by rotation of said drum; connecting the outlet of the fluid actuated motor to an outlet of a fluid pump, connecting an inlet of the fluid pump to a source of fluid and throttling the fluid flow from said pump to the fluid actuated motor with a control valve and throttling the valve in response to the magnitude of said control signal of step (4) to thereby retard rotation of said drum and achieve an upward force on said drill string.

7. Method of controlling weight on bit while drilling a borehole with a rotary drilling rig that includes a rotatable drill string having a drill bit connected at the lower end thereof, and a drawworks for lifting and lowering the string with a drilling line rove about a drawworks drum, a drawworks motor means for rotating the drum and moving the string uphole and downhole and thereby changing the elevation of the bit; and a drawworks brake means for rendering the drum non-rotatable; comprising the steps of:

(1) connecting another motor means to be rotated by said drum as said drilling line unspools from said drawworks drum; connecting a power source to said another motor means for applying a rotational force by said another motor means in opposition to the rotation as the drawworks drum unspools drilling line;

(2) weighing the drill string while said string is suspended off bottom and converting the resultant measurement to a signal that is proportional thereto;

(3) selecting a desired value of the weight on bit, and providing a signal that is proportional thereto;

(4) combining the signals of steps (2) and (3) to provide an operating signal that is representative of the tension required at the upper end of the drill string in order to continuously support the string with an uphole force that results in a weight on bit substantially equal to step (3) while drilling a borehole;

(5) controlling the rotational force that said another motor means applies to the drawworks drum in proportion to the magnitude of the operating signal of step (4) while drilling a borehole whereby the weight of said drill string rotates the drum to unspool cable therefrom while the another motor means resists unspooling of the cable so that the string is lowered at a rate which maintains said weight on bit of step (4) substantially constant.

8. The method of claim 7 and further including the steps of using a hydraulic motor and a pump as said another motor means by connecting said hydraulic motor to be driven by said drawworks drum and connecting an inlet of the hydraulic motor to a pump outlet, connecting a pump inlet to a source of hydraulic fluid and throttling the fluid flow to the hydraulic motor with a control valve in accordance with step (5) to thereby retard rotation of said drawworks drum and achieve an upward force on said drill string.

9. The method of claim 7 and further including the step of using a hydraulic motor for said another motor means and connecting said hydraulic motor to a source of fluid through a control valve means and throttling said control valve means as may be required to achieve said weight on bit.

10. The method of claim 9 and further including the steps of weighing the drill string by placing load cells in the lower end of a swivel, supporting the swivel with said drilling line, and supporting the drill string in the borehole from the load cells with the bit off bottom to thereby place the load cells in compression with a force equal to the tension in the upper end of the drill string.

11. The method of claim 10 and further including the steps of rotating the upper end of the drill string by direct coupling to a drill motor which is supported in underlying relationship respective to a swivel and forms part of said drill string; and, flowing drilling fluid through the swivel, through a hollow shaft of the drill motor, and down through the drill string to the bit.

12. The method of claim 8 and further including the steps of rotating said drill string with a direct drive motor; and, weighing said drill string at a location adjacent to the upper end of said direct drive motor.

13. The method of claim 7 and further including the step of connecting a hydraulic motor to be driven by rotation of said drawworks drum to thereby provide said another motor means; connecting the hydraulic motor to a source of fluid and throttling the fluid flow to the hydraulic motor with a control valve means in response to the operating signal of step (4) to retard rotation of said drawworks drum and thereby achieve control of the tension in said drill string.

14. A drilling rig having a top drive unit comprised of an electric motor connected to rotate the upper end of a drill string; a bit at the lower end of the string; a swivel supports the motor; drilling fluid flows through said swivel, and continues through a rotating hollow shaft of said motor; said swivel is supported from a traveling block which in turn is supported by a plurality of cable strands from a crown block, one end of the cable being rove about a drawworks drum so that rotation of the drum changes the elevation of the string; whereby as the tension in the cable is reduced the string is lowered and the bit engages and penetrates a formation;

first motor means for rotating said drum to thereby lift and lower said traveling block whereupon said swivel, electric motor, drill string and bit are lifted uphole and lowered downhole;

a second motor means connected to be rotated by unspooling of said drawworks drum; said second motor means applies a rotational force to said drawworks drum that is opposed to unspooling of said drawworks drum; said second motor means resists unspooling of the drawworks drum in proportion to the power delivered to said second motor means;

means weighing said drill string while the bit is off bottom and converting the weight measurement into a signal proportional thereto; means selecting a weight on bit, and converting the weight on bit selection into a signal proportional thereto; the weight on bit being a fraction of the drill string weight;

means combining the drill string weight signal and the selected weight on bit signal to provide an operating signal representative of the tension that must be effected in the cable in order to achieve said weight on bit;

and means controlling the power delivered to said second motor means in proportion to the magnitude of said operating signal to continually adjust the rotational force of the second motor means and thereby adjust the weight on bit to a value substantially equal to said selected value of the weight on bit.

15. The apparatus of claim 14 wherein said second motor means is a hydraulically actuated motor, a centrifugal charge pump connected to charge the hydraulic motor inlet, a flow control valve connected to controllably throttle fluid flow to the hydraulic motor, said flow control valve being connected to control flow from said charge pump;

said flow control valve, when actuated to admit flow therethrough, retards the speed of said hydraulic motor and reduces the rate at which the drawworks drum unspools the cable therefrom, thereby reducing the weight on bit.

16. In a rotary drilling unit having a drawworks drum which spools and unspools cable therefrom to raise and lower a drill string uphole and downhole in a borehole; a bit at the end of the string, a first motor connected to rotate said drum in either desired direction of rotation, brake means to prevent rotation of said drum; the improvement comprising:

means for weighing said drill string with the bit off bottom to provide a first signal which is proportional to said drill string weight;

a second motor connected to be rotated by said drum; said second motor means being connected to resist unspooling the cable when energized;

means for selecting a desired weight on bit during a drilling operation and providing a second signal proportional to said desired weight on bit;

means combining the first and second signals to provide an operating signal representative of the weight of the drill string required in order to achieve said desired weight on bit;

a controller for controlling the rotational force said second motor imparts into resisting the rotation of the drawworks drum; means connecting said operating signal to said controller so that the rotational power of said second motor changes in proportion to said operating signal to thereby unspool the cable at a rate to maintain said desired weight on bit substantially constant.

17. The improvement of claim 16 wherein said second motor is a hydraulic motor; a control valve means connecting the hydraulic motor to a source of fluid; and, means including said controller for throttling the control valve as may be required to achieve an upward force on said drill string and thereby maintain said weight on bit.

18. The improvement of claim 17 and further including weighing the drill string with the bit off bottom by placing load cells in the lower end of a swivel, the swivel being supported by said cable, the drill string being supported from the load cells to thereby place the load cells in compression with a force equal to the tension in the upper end of the drill string.

19. The improvement of claim 18 wherein the upper end of the string is rotated by direct coupling to a direct drive electric motor which is supported in underlying relationship respective to the swivel and forms part of said drill string; and, drilling fluid flows through the swivel, through a hollow shaft of the electric motor, and down through the drill string to the bit.

20. The improvement of claim 16 wherein said drill string is rotated with a direct drive motor; and, said drill string is weighed at a location adjacent to the upper end of said direct drive motor.

21. The improvement of claim 16 wherein a hydraulic motor is connected to be driven by said drum to thereby provide said second motor means; a pump having an inlet and an outlet; and means connecting the inlet of the hydraulic motor to the pump outlet, means connecting the pump inlet to a source of fluid; and a control valve means for throttling the fluid flow to the hydraulic motor, said control valve means is operated by said controller in proportion to the operating signal to thereby retard rate of rotation of said drum and achieve an upward force on said drill string to maintain said desired weight on bit.

22. A weight on bit control system for a drilling rig that has a drill string including a bit attached at the lower end thereof, and means for rotating the upper end thereof; and a drawworks having a cable drum that rotates to spool a cable on and off the drum, the cable being attached to vertical movement of the upper end of the string, thereby enabling the drill string to be lifted and lowered within the borehole in response to drum rotation;

a first motor means for rotating said drum and lifting said drill string uphole and lowering said string downhole; brake means by which the drum can be rendered non-rotatable;

means forming a bit weight set point for selecting the desired weight on bit while making hole; means for weighing said drill string while the bit is off bottom and while the bit is drilling and making hole; and means for converting the selected bit weight and the weight of the drill string into an operating signal wherein the magnitude of the operating signal varies with the change of weight of the drill string while the bit is drilling and making hole;

a second motor means connected independently of said first motor means and said brake means to reduce the rate of unspooling of said drum, said second motor means is connected to be rotated in one direction by the unspooling of the drawworks drum and to exert a torque in the other direction in response to the power delivered to said second motor means; means controlling the power delivered to said second motor means in proportion to said operational signal; whereby: the rate of descent of the drill string is controlled and thereby maintains the weight on bit substantially equal to said set point.

* * * * *